US006877486B2

(12) United States Patent
Ellies et al.

(10) Patent No.: US 6,877,486 B2
(45) Date of Patent: Apr. 12, 2005

(54) METHOD AND APPARATUS FOR PREDICTING A FUEL INJECTOR TIP TEMPERATURE

(75) Inventors: Benjamin D. Ellies, Ann Arbor, MI (US); Mark E. Johnston, Highland, MI (US); Guojun Shi, Canton, MI (US); Michael Denny Parr, Highland, MI (US)

(73) Assignee: General Motors Corporation, Detroit, MI (US)

( * ) Notice: Subject to any disclaimer, the term of this patent is extended or adjusted under 35 U.S.C. 154(b) by 23 days.

(21) Appl. No.: 10/662,840

(22) Filed: Sep. 15, 2003

(65) Prior Publication Data

US 2005/0056260 A1 Mar. 17, 2005

(51) Int. Cl.[7] ..... F02M 51/00
(52) U.S. Cl. ..... 123/478; 73/119 A
(58) Field of Search ..... 123/478, 480, 123/179.15, 689; 73/119 A, 118.1, 118.2

(56) References Cited

U.S. PATENT DOCUMENTS 4,656,829 A * 4/1987 Creps et al. ..... 60/277
6,003,498 A 12/1999 Reddy
6,598,471 B2 * 7/2003 Imoehl ..... 73/119 A
6,609,495 B1 * 8/2003 Cornell et al. ..... 123/321

* cited by examiner

*Primary Examiner*—Mahmoud Gimie
(74) *Attorney, Agent, or Firm*—Christopher DeVries

(57) ABSTRACT

Methods and apparatus for accurately predicting a fuel injector tip temperature (FITT) are described. One technique for predicting the temperature of a fuel injector tip in an engine suitably includes the steps of estimating an initial temperature of the fuel injector tip and calculating a steady state temperature of the fuel injector tip. A filter coefficient is determined as a function of a rate of airflow into the engine, and the temperature of the fuel injector tip is predicted as a function of said initial temperature, the steady state temperature, and the filter coefficient. In a further embodiment, the steady state temperature is filtered into a feedback temperature at a rate that is determined by the filter coefficient.

20 Claims, 8 Drawing Sheets

METHOD AND APPARATUS FOR PREDICTING A FUEL INJECTOR TIP TEMPERATURE

TECHNICAL FIELD

The present invention generally relates to fuel injectors for an engine, and more particularly relates to predicting the fuel injector tip temperature in an engine.

BACKGROUND

Internal combustion engines, as are typically used in automotive and other engine-driven applications, are generally powered by the burning of a mixture of fuel and air in the combustion chambers of the cylinders in an engine. For many years, the carburetor was the preferred mechanism for controlling the mix of air and fuel. More recently, however, the carburetor has been largely superseded by the fuel injection system, since the fuel injection process usually provides better control of the parameters affecting engine performance.

Generally all new automobiles with internal combustion engines utilize some form of fuel injection system in an effort to enhance engine characteristics such as fuel efficiency, responsiveness and exhaust pollution control. While fuel injection systems vary widely, they are typically managed by an automatic electronic control system. For example, sensors are typically located in various parts of an automobile to provide feedback signals, such as engine speed, intake air temperature, driving conditions, and other parameters affecting engine performance. These signals are generally connected to a control processor within the electronic control system, which manages the operation of the fuel injection system in response to the sensor input signals.

A key element of a typical fuel injection system is the fuel injector, which usually includes a nozzle, a valve (e.g., a needle or ball valve) associated with the nozzle, and a compression spring. In a typical operation, the electronic control system causes fuel to be pumped into the injector with sufficient pressure to compress the spring. The spring forces the injector valve to open the nozzle, enabling a controlled burst of fuel mist to be sprayed into a corresponding combustion chamber. The fuel mist is combined in the chamber with a quantity of air appropriate for ignition.

The electronic control system generally provides for precisely timed opening and closing cycles of the injector valve, which can be in excess of 1,000 times per minute at highway speeds. In addition to controlling the timing of the injector open/close cycle, the electronic control system can also control the fuel supply, the ratio of air and fuel in the combustion chambers, and the timing of the ignition system. As such, a modern electronically controlled fuel injection system can provide a relatively high level of engine performance efficiency, with reduced exhaust emissions and improved fuel economy.

In order for an electronic control system to manage a fuel injection system efficiently, various strategies are employed for controlling the fuel-to-air ratio in the combustion chambers, as well as other factors. At least some of these control strategies are dependent on the temperature levels of various measured engine parameters, such as intake air, engine coolant, oil temperature and recirculated engine exhaust gas (EGR). However, cost and durability concerns limit the practicality of additional measurement devices in a mass-produced engine. Indirect estimating techniques are therefore often used to predict air intake or exhaust temperatures that are otherwise difficult to measure directly.

Another engine parameter that is difficult to measure directly is the operating temperature of a fuel injector tip, which will be referred to hereinafter as the fuel injector tip temperature, or FITT. Accurately predicting this temperature (FITT) under different engine operating conditions, such as running and restart, can enable an electronic control system to better correlate the injector temperature with a fuel compensation/enrichment strategy for optimizing engine performance.

In the case of a hot restart condition, for example, when a running engine has been shut down for a relatively short time (e.g., 15 to 45 minutes) and then restarted, it is possible for the fuel temperature to increase sufficiently to cause a vapor lock condition at the fuel injectors. That is, the fuel may vaporize because of its extreme temperature before it can be properly injected into the combustion chamber. When this occurs, it is generally desirable to implement some type of fuel compensation strategy, such as fuel enrichment (increasing the fuel-to-air ratio), or vapor purge, where the fuel tank vapor is captured and ingested into the intake manifold. It is therefore desirable to be able to predict the fuel temperature at the injector as accurately as possible under hot restart conditions, in order to provide an optimally efficient fuel compensation strategy.

Prior strategies for identifying hot engine restart conditions were typically based upon engine parameters such as shutdown time, shutdown coolant temperature, shutdown transmission oil temperature or shutdown air temperature. These parameters are generally cross-referenced to fuel compensation tables during the hot restart to determine the need for some type of fuel compensation strategy. This technique may falsely trigger excess fuel compensation and/or purge upon a hot restart, however, since the fuel compensation table information may not accurately represent the engine operating dynamics that cause hot fuel temperatures.

Accordingly, it is desirable to provide an apparatus and method for accurately predicting the FITT in an operating engine in which hot fuel temperatures exist. In addition, it is desirable to utilize the predicted FITT as a calibration basis for fuel compensation strategies. Furthermore, other desirable features and characteristics of the present invention will become apparent from the subsequent detailed description of the invention and the appended claims, taken in conjunction with the accompanying drawings and this background of the invention.

BRIEF SUMMARY

Methods and apparatus for accurately predicting a fuel injector tip temperature (FITT) are described. One technique for predicting the temperature of a fuel injector tip in an engine suitably includes the steps of estimating an initial temperature of the fuel injector tip and calculating a steady state temperature of the fuel injector tip. A filter coefficient is determined as a function of a rate of airflow into the engine, and the FITT is predicted as a function of said initial temperature, the steady state temperature, and the filter coefficient. In a further embodiment, the steady state temperature is filtered into a feedback temperature at a rate that is determined by the filter coefficient.

In a further exemplary embodiment, a computing apparatus suitably includes a processor and memory having instructions stored therein to calculate a steady state fuel injector tip temperature for a running engine, and for calculating an initial injector tip temperature at start up. The processor and memory are further configured to combine the calculated temperatures and/or feedback data mathematically at a rate determined by a filter coefficient to produce a predicted value for the fuel injector tip temperature. The filter coefficient may be determined as a function of airflow into the engine.

BRIEF DESCRIPTION OF THE DRAWINGS

The present invention will hereinafter be described in conjunction with the following drawing figures, wherein like numerals denote like elements.

DETAILED DESCRIPTION OF EXEMPLARY EMBODIMENTS

The following detailed description of the invention is merely exemplary in nature and is not intended to limit the invention or the application and uses of the invention. Furthermore, there is no intention to be bound by any theory presented in the preceding background of the invention or the following detailed description of the invention.

According to various embodiments of the invention, fuel injector tip temperatures (FITT) in an engine are predicted for different operating conditions. The prediction calculations are generally based on engine operating parameters, such as coolant, air and oil temperatures, which are then processed using empirical formulas or algorithms as appropriate to arrive at an accurate predicted value for FITT. Generally speaking, FITT may be computed using a lag filter routine as a function of a steady state temperature and a feedback temperature from a prior iteration of the routine. Because no feedback data is typically available at engine startup, an initial value for FITT may be appropriately estimated, as described more fully below. The predicted fuel injector tip temperatures may be useful in controlling the fuel injection system to enhance the efficiency of engine performance, to identify potential vapor lock and/or "hot restart purge" conditions, and the like.

Figure 1:
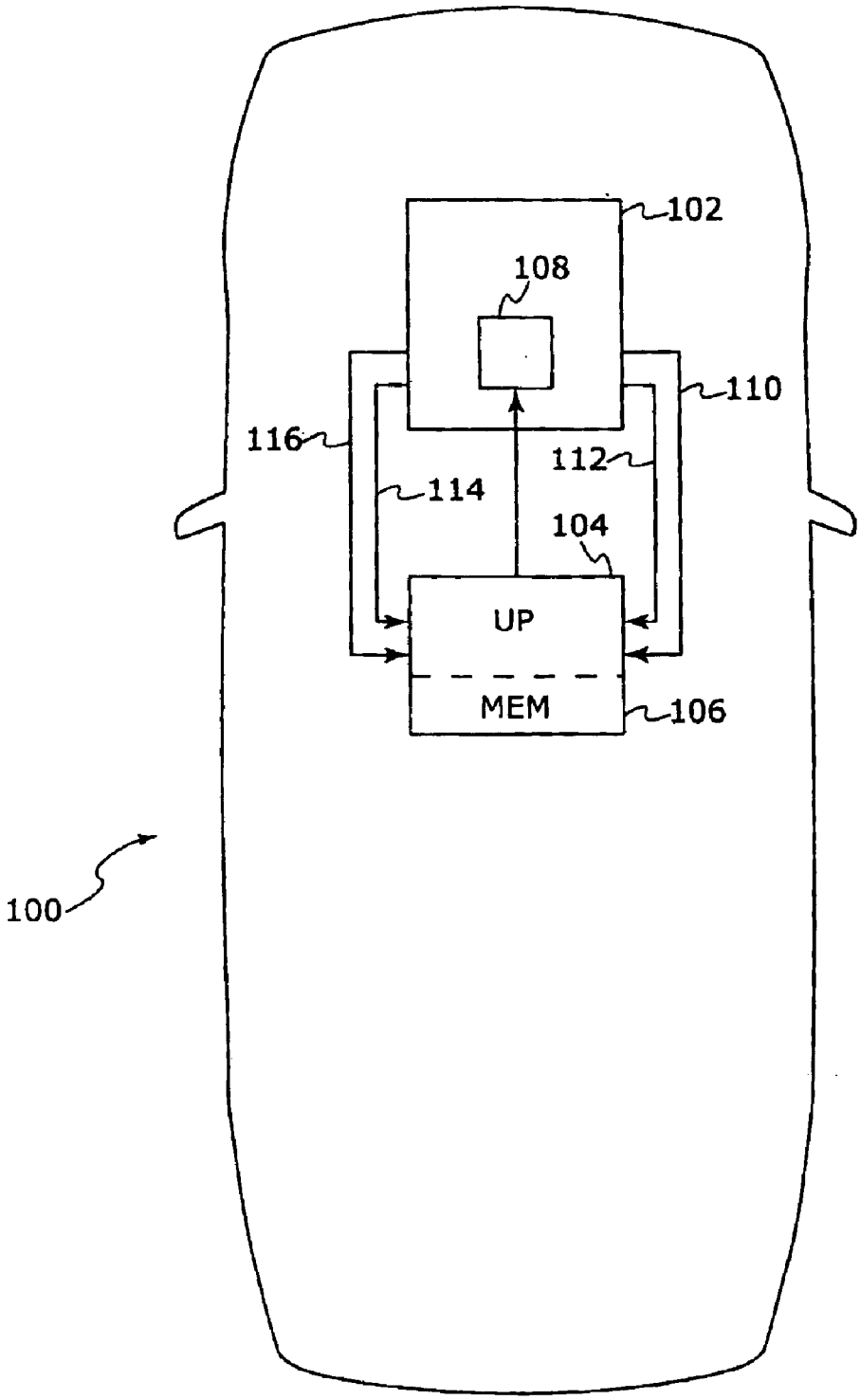
FIG. 1 is a block diagram of an exemplary automatically controlled fuel injection system for an engine.

An exemplary arrangement of an automotive engine fuel injection system 100 is shown in simplified form in FIG. 1. An engine 102 typically supplies sensor data (on lines 110, 112, 114, 116) back to a processor 104, which is suitably coupled to a memory 106. For example, the sensor data may include air intake temperature data 110, exhaust gas flow data 112, engine oil temperature data 114, and engine coolant data 116, as well as other parameters relative to engine performance. Processor 104 is generally coupled to a fuel injection system 108, and provides control signals to manage the operation of fuel injection system 108 as appropriate. Processor 104, in conjunction with memory 106, will typically also perform the calculations for determining predicted injector temperatures and for determining appropriate control signals provided to fuel injection system 108, as will be described more fully below. Processor 104 may be any type of microprocessor, microcontroller or other computing device capable of executing instructions in any computing language. Memory 106 is any digital storage device such as any static or dynamic random access memory (RAM), read-only memory (ROM), EEPROM, flash memory, optical or magnetic drive, or the like. In an exemplary embodiment, processor 104 and memory 106 are components in an engine control module (ECM), as appropriate.

Figure 2:
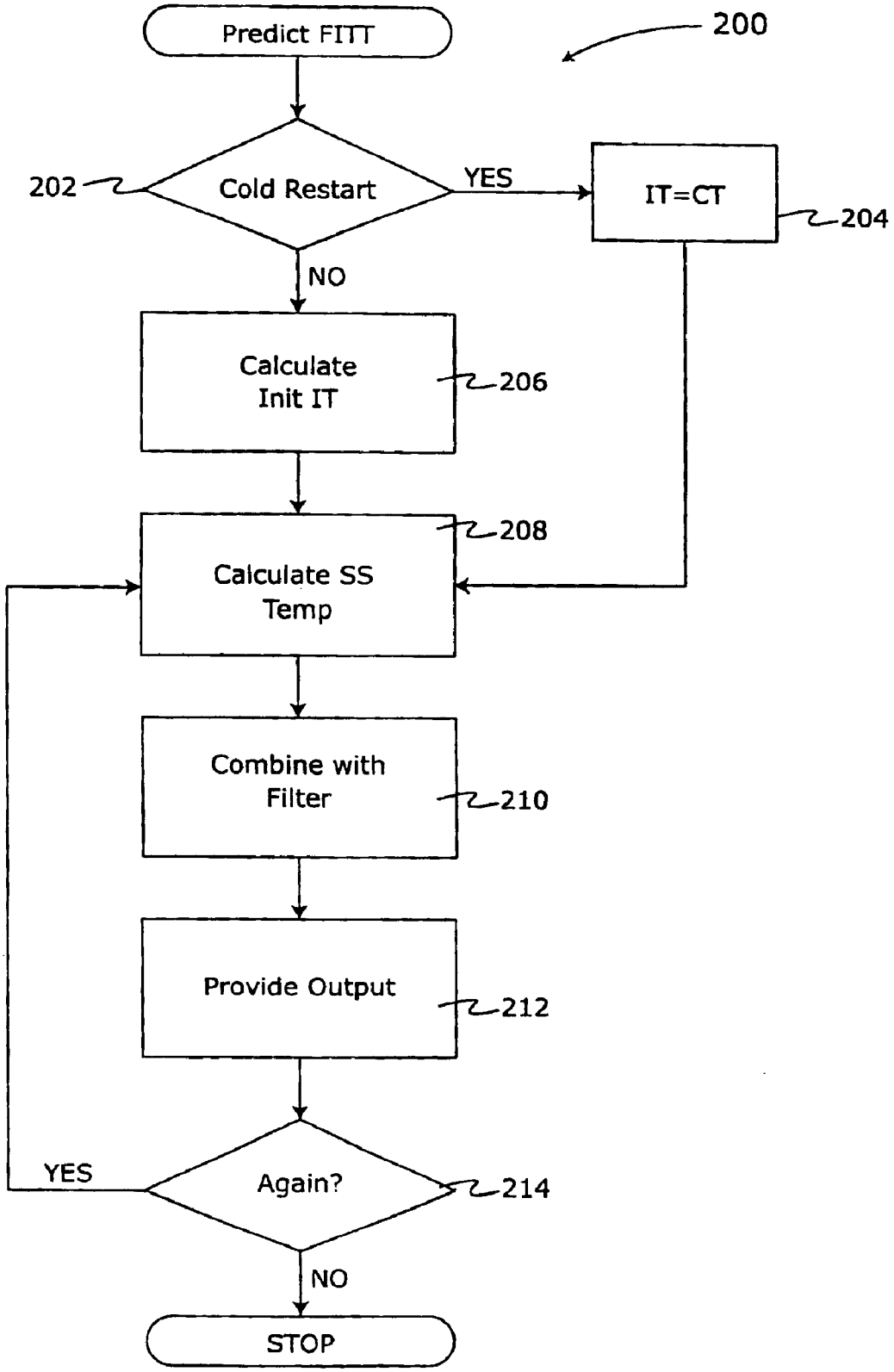
FIG. 2 is a flow diagram for an exemplary injector temperature prediction technique.

An exemplary overview of a method 200 for predicting engine fuel injector tip temperature (FITT) is shown in flow diagram form in FIG. 2. With reference to FIG. 2, an exemplary method 200 of predicting the temperature of a fuel injector tip includes the broad steps of determining an initial temperature (IT) value (steps 202, 204, 206), calculating a steady state (SS) temperature value (step 208), and determining a run-stage prediction for FITT based upon the initial and steady state temperatures (step 210). FITT may be provided as an output (step 212), and the prediction process 200 may be repeated (step 214) as appropriate.

When the engine is started, a determination is made regarding the start up temperature of the fuel injector (step 202). If the engine is cold, the fuel injector temperature may be assumed to take a default value, such as a value equal to the engine coolant temperature (step 204). If the engine is warm, a calculation of predicted fuel injector temperature (step 206) is made based on the soak time (i.e. the time that the engine was turned off) and other parameters as appropriate.

Step 208 represents a calculation of predicted steady state fuel injector temperature, based on an empirical combination of engine parameters such as engine coolant temperature, air temperature, oil temperature and/or other factors as appropriate.

In step 210, the calculated steady state temperature and initial temperature are processed with a filter coefficient as appropriate to provide an output that represents a current predicted fuel injector temperature (step 212). The resulting predicted fuel injector temperature may be looped back into subsequent iterations of process 200 and recalculated to update the predicted FITT as appropriate (step 214).

Figure 3:
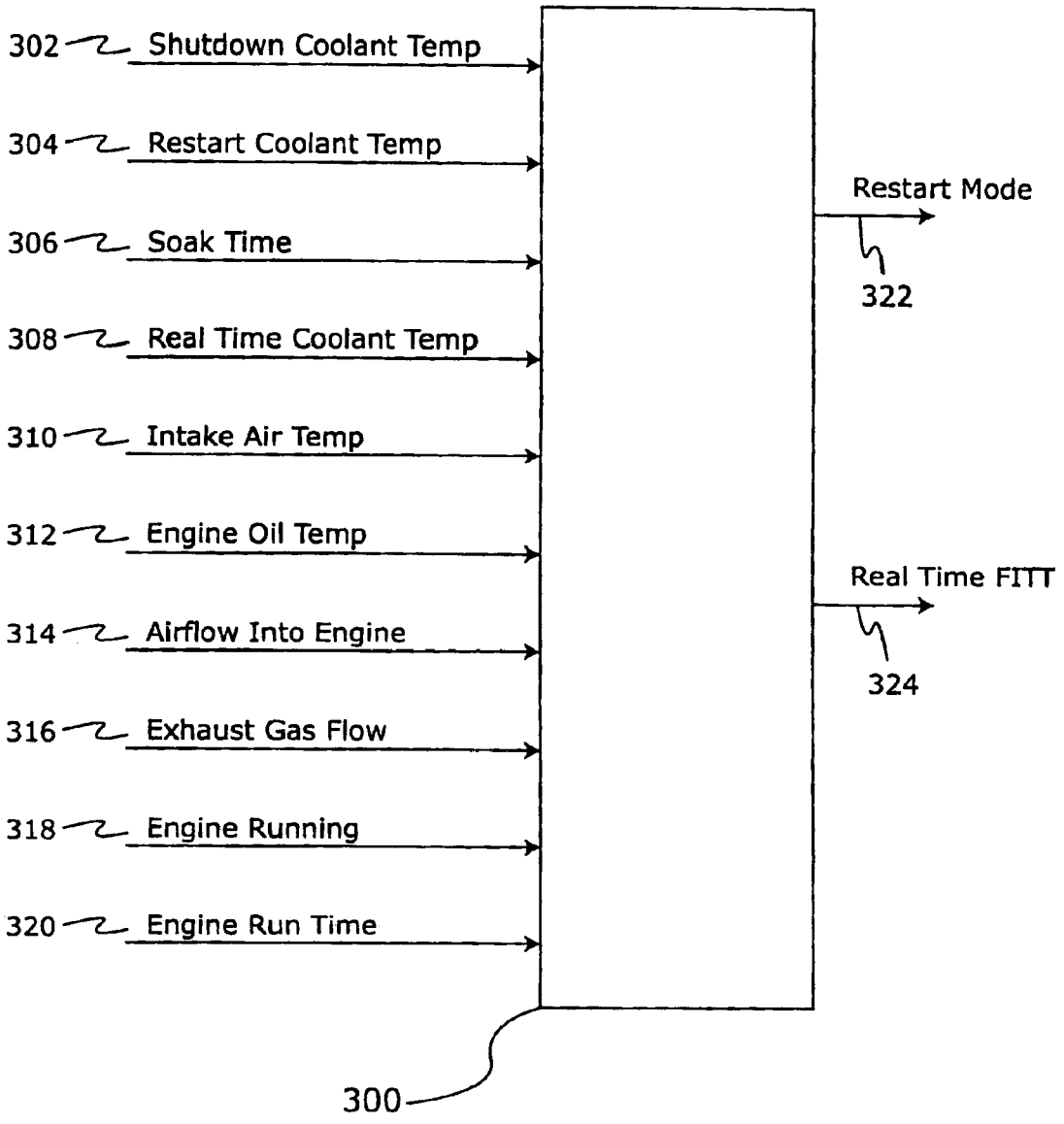
FIG. 3 is a block diagram of an exemplary temperature predictor module.

Referring now to FIG. 3, an exemplary embodiment of a fuel injector tip temperature predictor module 300 is shown in simplified form. Predictor 300 represents any process, application, thread, module, applet or other routine executing on a processing device such as processor 104 (FIG. 1). In this embodiment, predictor 300 suitably receives various signal inputs 302–320 representing various engine parameters and vehicle conditions, in a manner similar to that shown in FIG. 1 for the processor 104 and memory 106. Predictor 300 uses these inputs to calculate a predicted fuel injector temperature based on the dynamic condition of the engine.

Data inputs provided to predictor 300 suitably include various engine parameters that factor into the predicted FITT. The exemplary inputs shown in FIG. 3 include several factors related to a running engine being shut down for a period of time, and then restarted and brought up to a running condition. The time period of engine shut down will be referred to hereinafter as "soak time" 306, which may be measured with a timer, crystal, clock or other timing device in communication with processor 104. At the time of engine shut down, a shutdown engine coolant temperature 302 may be measured and stored in memory (e.g. memory 106 (FIG. 1)) associated with predictor 300 as appropriate. At the time of engine restart, the engine coolant temperature can be measured again, and the value also typically stored in the memory 106 of processor 104 via line 304.

Examples of data that may be gathered in various embodiments include engine coolant temperature 308, intake air temperature 310, engine oil temperature 312 (which may be sensed and/or modeled, as appropriate), airflow into the engine 314, recirculated exhaust gas flow 316, and/or the like. The various data inputs 302–320 may be detected by sensors placed throughout the vehicle, and/or may be computed, modeled or otherwise processed by processor 104 or the like. In various embodiments, data inputs 302–320 are stored in memory 106 for rapid retrieval by processor 104. In addition, an engine running flag 318 tells predictor 300 if the engine is running, and engine run time 320 may also be provided. Predictor 300 suitably manipulates the various data factors 302–320 as described below to generate a predicted real time fuel injector tip temperature (FITT) 324 that may be used to control fuel injection system 108 or for any other purpose. In various embodiments, predictor 300 also computes a "hot restart" status flag 322 to indicate a hot restart condition as appropriate, and as described more fully below.

Figure 4:
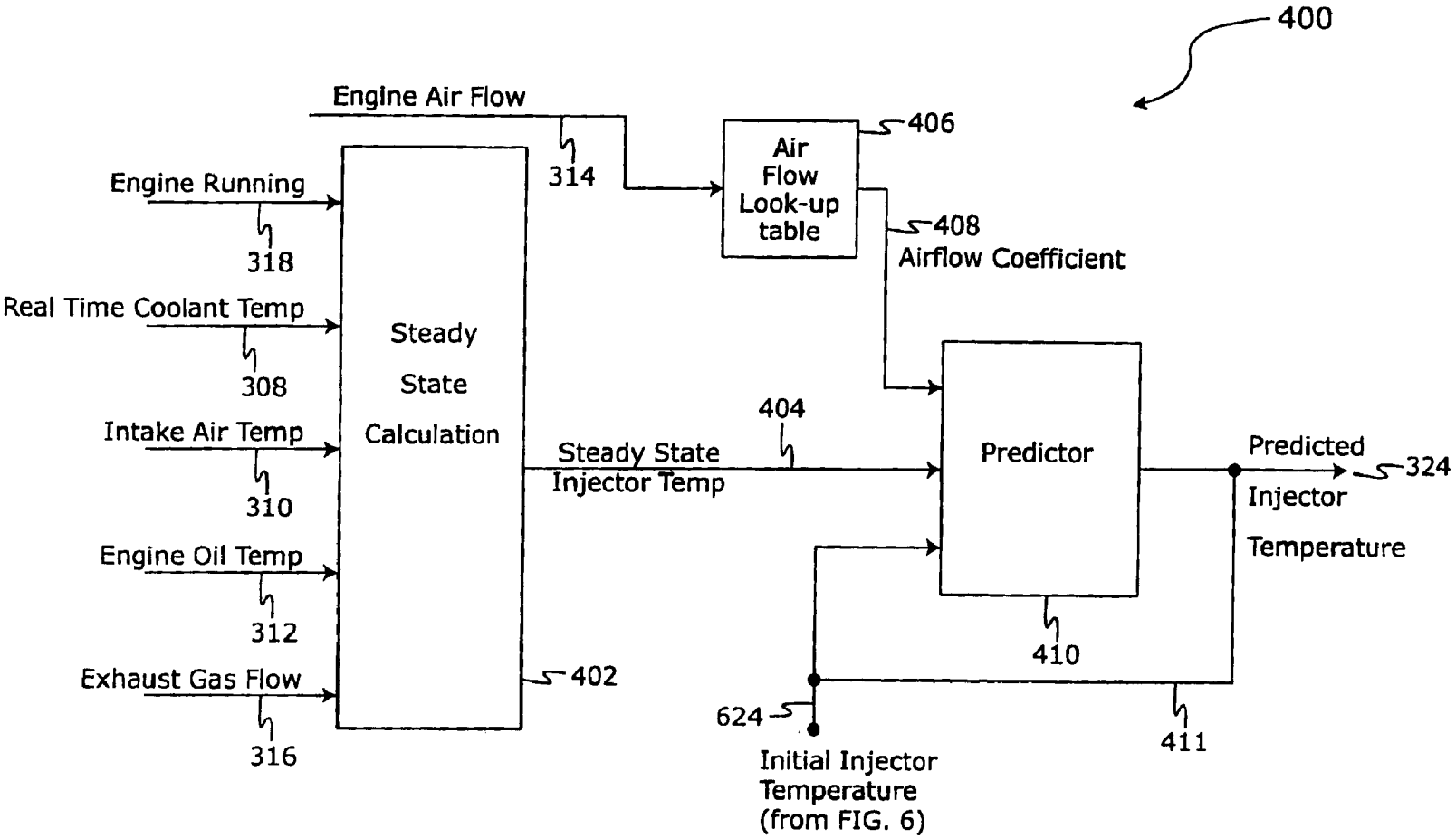
FIG. 4 is a logic diagram of an exemplary temperature prediction process.

An exemplary processing layout 400 for predicting fuel injector tip temperature is shown in block diagram format in FIG. 4, with modules 402, 406 and 410 representing various programming functions, subroutines, software modules, objects or the like. Generally speaking, predictor algorithm 410 operates as a lag filter that filters the calculated steady state injector temperature ($T_{ss}$) 404 into the current injector temperature ($T_{curr}$) 411 using filter coefficients (e.g. $K_1$, $K_2$) 408 that are based upon the rate of airflow into the engine. Filtering make take place using any scheme. In various embodiments, the relative contributions of predicted and current injector temperature may be shown by:

$$K_1T_{ss}+K_2\,T_{curr}$$

Because engine airflow affects the cooling rate of the injector tips, coefficients $K_1$ and $K_2$ are appropriately selected so that filtering takes place at a higher rate when airflow is relatively high. Coefficients $K_1$ and $K_2$ are obtained in any manner, such as from a lookup table 406 or similar correlative module or function that provides an appropriate coefficient value for an observed rate of engine airflow 314. Alternatively, one or more of the coefficients may be computed from the airflow data 314 using an appropriate mathematical relationship. In an exemplary embodiment, K, may be approximately equal to 1-$K_2$ to further simplify computation and lookup requirements. $K_1$ may be approximately 0.99 for an average airflow, for example, and may be approximately 0.95 when a particularly high airflow is observed. $K_2$, conversely, may be approximately 0.01 for average airflow and 0.05 for high airflow, as appropriate. The particular values provided herein for the coefficients are for exemplary purposes only, and may vary significantly from embodiment to embodiment.

To calculate predicted steady state temperature, various operating parameters such as engine running flag 318, real time coolant 308, intake air temperature 310, engine oil temperature 312, and recirculated exhaust gas flow 316 are provided to a steady state calculation routine 402. Routine 402 calculates a weighted average of coolant temperature 308, air temperature 310 and oil temperature 312, and optionally combines this weighted average with an offset value related to exhaust gas flow 316 to arrive at a predicted steady state fuel injector temperature 404.

Figure 5:
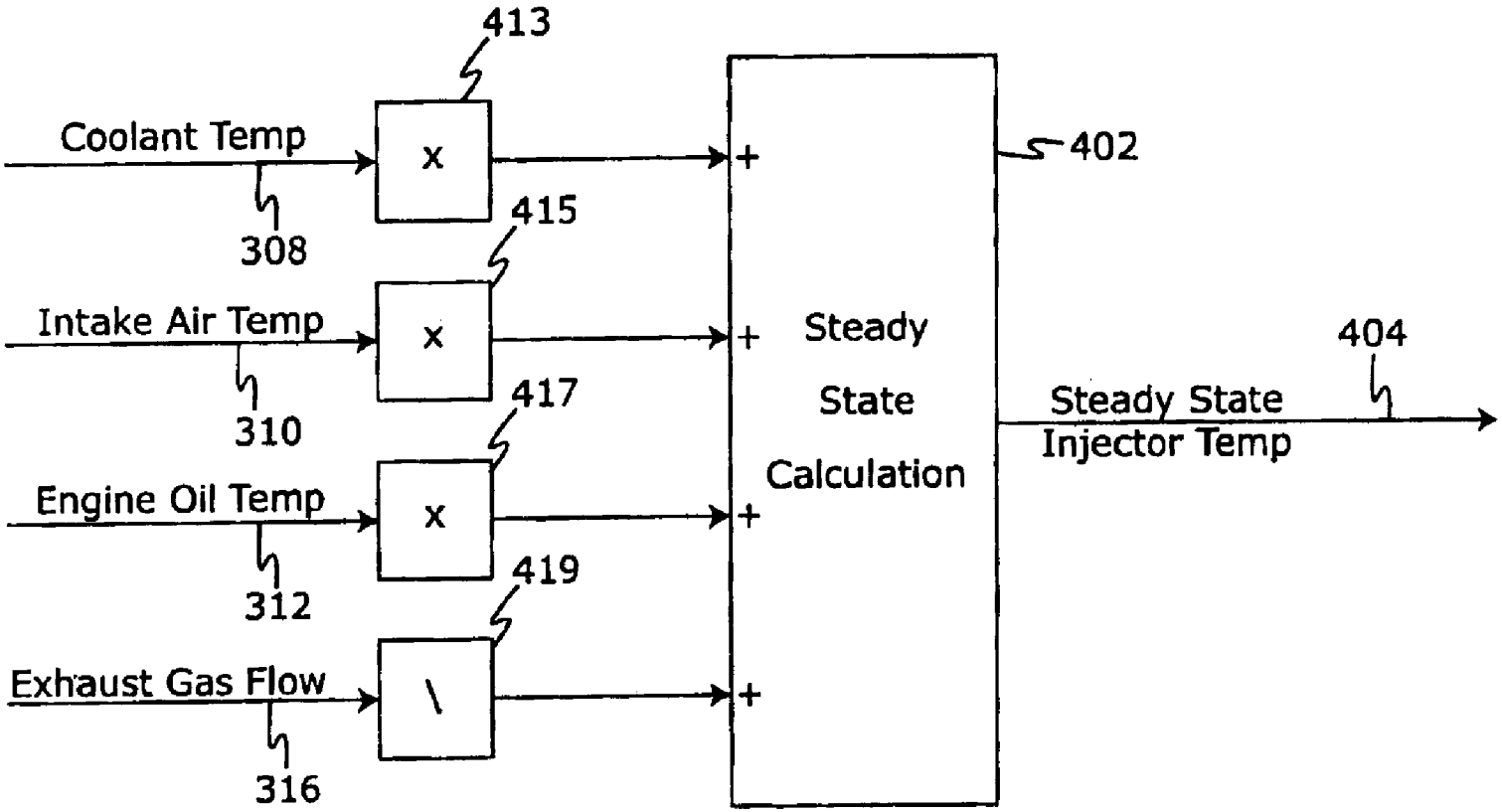
FIG. 5 is a logic diagram of an exemplary technique for calculating steady state injector temperature.

Referring now to FIG. 5, an exemplary embodiment of the steady state fuel injector temperature calculation in FIG. 4 is depicted in more detail in FIG. 5. As briefly mentioned above, steady state calculation routine 402 appropriately computes a weighted average of various factors. Coolant temperature 308, intake air temperature 310, engine oil temperature 312 and/or the like may be provided in various embodiments and processed as appropriate. The particular weighting factors used to compute the weighted average may vary widely from implementation to implementation. In certain engines, for example, engine oil temperature 312 may be modeled instead of being directly measured, thereby decreasing the accuracy of oil temperature data 312. In such embodiments, then, oil temperature data 312 may be weighted very lightly or may even be omitted from the calculation of weighted average. In the example shown in FIG. 5, coolant temperature 308 is combined with a weighting factor 413 (e.g., approximately 0.36), intake air temperature 310 is combined with a weighting factor 415 (e.g., approximately 0.64), engine oil temperature 312 is combined with a weighting factor 417 (typically very small, as described above), and recirculated exhaust gas flow 316 is converted to an offset value 419. The resultant values (413, 415, 417, 419) are suitably combined by routine 402 to generate a steady state fuel injector temperature 404. Again, the particular formula used to compute weighted average 404 may vary widely from embodiment to embodiment, and may include any number of temperature measurements scaled and/or weighted by any values.

Figure 6:
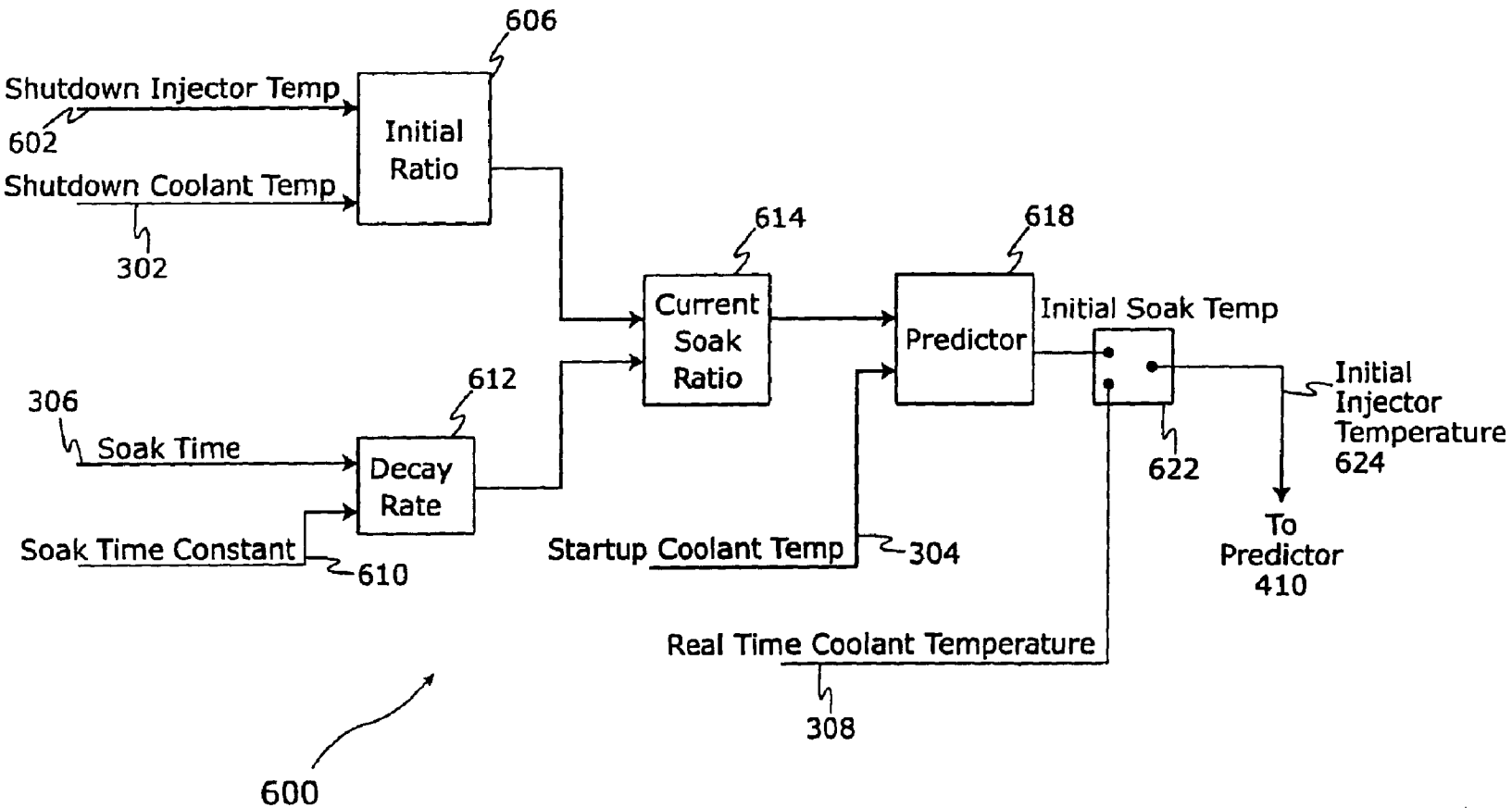
FIG. 6 is a logic diagram of an exemplary technique for calculating initial injector temperature.

An exemplary embodiment of an initial fuel injector temperature calculation 600 is illustrated in FIG. 6. In this embodiment, it is assumed that a running engine has been shut down for a period of time (i.e., the soak time), and then restarted. At engine shut down, it is assumed that the last fuel injector tip temperature 602 was measured and stored in a processor memory (e.g. memory 106 in FIG. 1), and that the shut down engine coolant temperature 302 was also measured and stored. The ratio of these temperature values is suitably calculated as an initial ratio 606.

At engine restart, for example, a soak time 306 and a soak time constant 610 are combined to generate a soak time decay rate 612, where soak time constant 610 is typically based on the inherent characteristics of the engine. The initial ratio 606 is mathematically combined with the decay rate 612 to produce a current soak ratio 614. A start up coolant temperature 304 is then typically combined with current soak ratio 614 in a mathematical predictor routine 618 to produce an initial soak temperature, representing a fuel injector temperature at the time of engine restart.

Generally speaking, a predicted initial value for the injector temperature may be computed based upon the startup engine coolant temperature 304, the ratio of the injector temperature 602 to the coolant temperature 302 at engine shutdown, and the soak time 306 for the engine. An exemplary formula for the calculation of initial soak temperature is:

$$T_{\text{injector_restart}} = T_{\text{coolant_restart}}\left(1-\left(1-\frac{T_{\text{injector_shutdown}}}{T_{\text{coolant_shutdown}}}\right)e^{-K(Time_{soak})}\right)$$

where K is an empirically derived constant 610 (e.g. a constant on the order of 0.05/minute) that is used to scale the temperature ratio such that the initial injector temperature 624 becomes closer to the restart engine coolant temperature 304 as soak time 306 increases. Alternatively, process 600 may simply set the initial injector temperature 624 to be equal to startup coolant temperature 304 if the engine has been soaking longer than a predetermined time (e.g. on the order of several hours or more). This feature may be implemented with conventional IF-THEN switching logic 622 or the like. While FIG. 6 shows one technique for processing initial injector temperature 624, various equivalent techniques could be formulated in alternate embodiments.

With reference again to FIG. 4, the estimation of initial injector temperature 624 can be provided as an initial input to predictor algorithm 410 to calculate an appropriate predicted value 324 for FITT. After the initial calculation of FITT, the calculated value may replace initial temperature 624 for subsequent calculations. That is, predictor algorithm 410 suitably operates in a feedback configuration to filter predicted FITT 324 to be increasingly close to the steady state temperature 404 using scaling coefficients as described above. An accurate estimation of FITT has a number of beneficial uses within a conventional vehicle. FITT may be used as a factor in determining appropriate control signals from processor 104 to fuel injection system 108 (FIG. 1), for example, or to identify potential vapor lock and/or hot restart conditions. Because the exemplary techniques described herein predict restart fuel injector temperature based on calculations rather than on a look-up table, it is expected that the calculating methods described herein will provide more accurate fuel injector temperature values under dynamic engine conditions than would be available from a look-up table method, thereby improving engine performance.

A significant benefit of improved temperature prediction accuracy involves the implementation of fuel compensation strategies, such as a hot restart vapor purge (HRP). Under hot restart conditions, the fuel injector temperature may reach a vaporization temperature that degrades the combustion process. In this type of situation, the control processor (e.g., 104 in FIG. 1) is usually configured to activate a fuel compensation strategy in order to enrich the fuel injection process. One type of conventional fuel compensation strategy involves releasing fuel vapors retained in a canister into the engine combustion chamber to prevent excessive fuel emissions from being released into the atmosphere. Exemplary criteria for activating a fuel compensation strategy include injector fuel temperature and engine running time. One type of canister purge control strategy is described in U.S. Pat. No. 6,003,498, although the various techniques described herein could be used with any type of fuel compensation strategy as described above.

Figure 7:
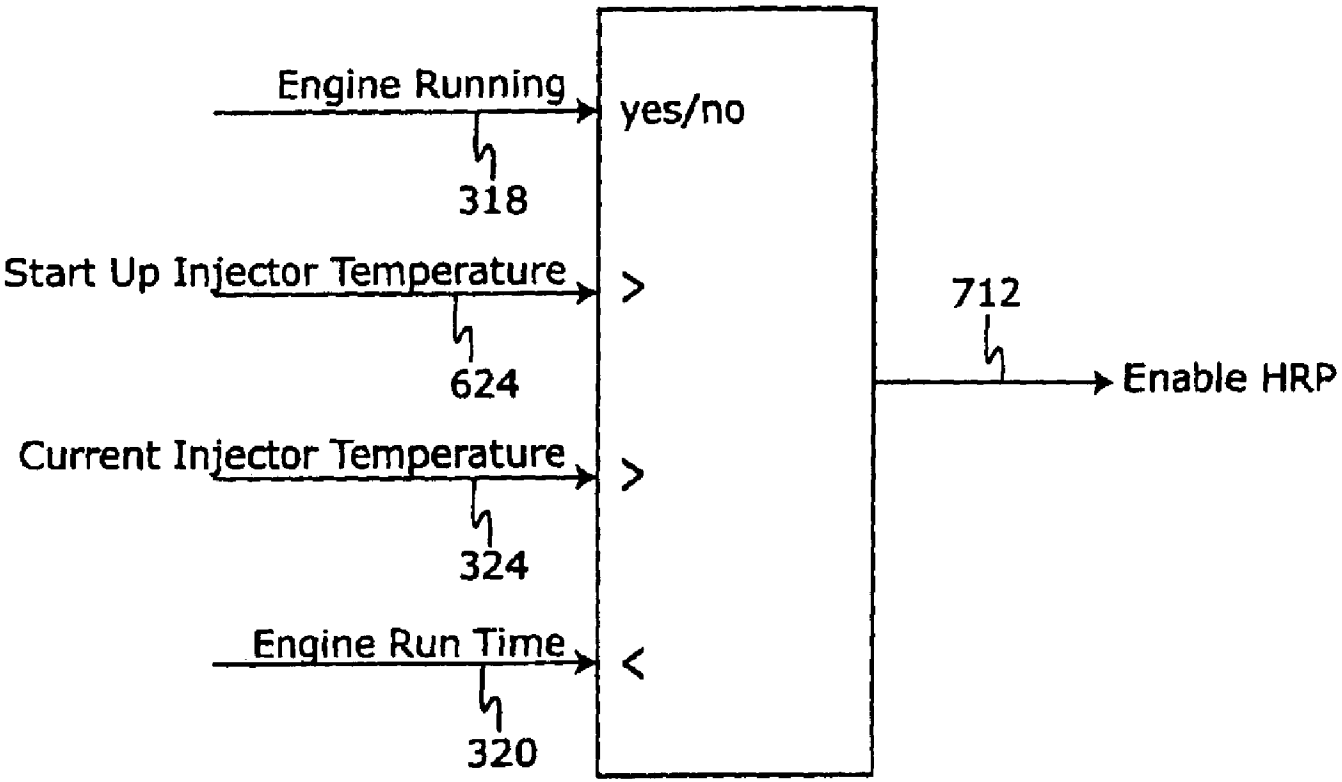
FIG. 7 is a logic diagram for an exemplary module for identifying a hot restart purge condition.
Figure 8:
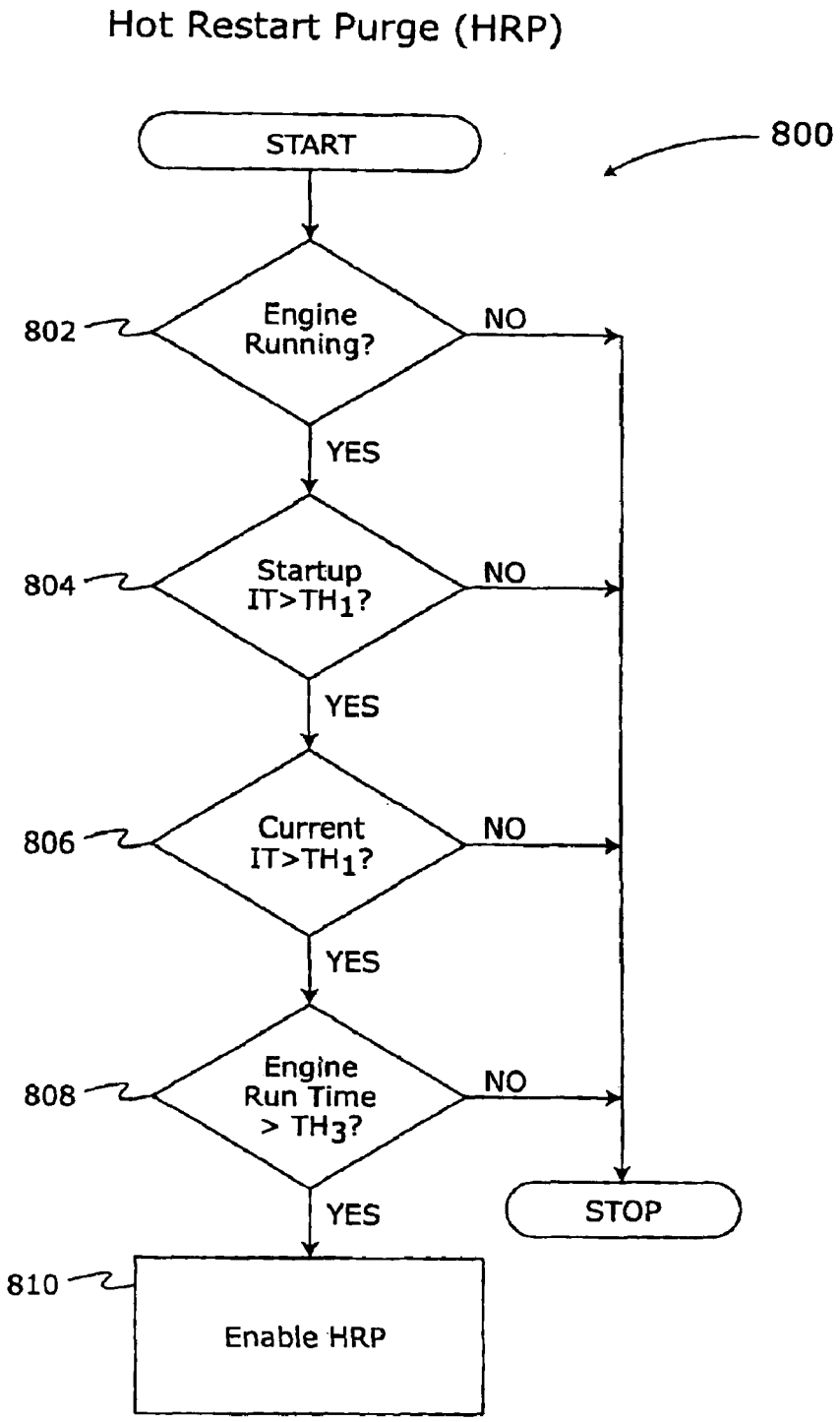
FIG. 8 is a flow diagram for an exemplary a hot restart purge technique.

An exemplary technique for enabling a hot restart purge (HRP) compensation action is illustrated in FIGS. 7 and 8. Referring now to FIG. 7, a logic module 702 receives an engine running flag 318, a start up fuel injector temperature 624, a current injector temperature 324, and an engine run time measurement 320. If all the enabling criteria are met, logic 702 will generally output an enable HRP signal 712 to activate a vapor purge system (not shown) when conditions are appropriate.

Referring now to the flow diagram of FIG. 8, an exemplary process 800 for identifying an HRP condition suitably includes the broad steps of comparing startup FITT 624, current FITT 324 and engine run time 320 against various threshold values. Prior to the comparison steps, process 800 optionally determines if the engine is running (step 802). If the engine is not running, the process stops. If the engine is running, the process continues by determining if the start up fuel injector temperature 624 is above a first predetermined threshold value $TH_1$ (step 804). An exemplary threshold value for step 804 is on the order of about 115° C. If startup FITT 624 is above the threshold temperature, processing continues (step 806) until the current fuel injector temperature 324 no longer exceeds a second predetermined disable threshold value $TH_2$ (which may be on the order of about 105° C.). If the current FITT remains greater than the second threshold value, processing further continues (step 808) to determine if the engine running time is less than a third threshold $TH_3$, which may be on the order of about three hundred seconds or so, although this value may vary widely from embodiment to embodiment. Finally, if all criteria are met, step 810 generates an enable HRP command, as represented by enable HRP signal 712 in FIG. 7, to initiate a hot restart purge of the fuel vapor canister.

Accordingly; the shortcomings of the prior art have been overcome by providing an improved technique for predicting a fuel injector temperature. The exemplary technique includes calculating an initial injector temperature at engine restart based on the dynamic physical parameters that affect hot fuel temperatures, rather than on static look-up table data. As such, fuel compensation strategies can be based on more accurate information, thereby leading to improved engine performance efficiency.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of predicting a fuel injector tip temperature (FITT) in an engine, comprising the steps of:

estimating an initial temperature of the fuel injector tip;

calculating a steady state temperature of the fuel injector tip;

determining a filter coefficient as a function of a rate of airflow into the engine; and predicting the FITT as a function of the initial temperature and the steady state temperature, wherein the steady state temperature is filtered into the FITT at a rate determined by the filter coefficient.

2. The method of claim 1 wherein the estimating step is determined as a function of a ratio between a shutdown injector temperature and a shutdown temperature of an engine coolant.

3. The method of claim 2 wherein the ratio is adjusted to decay as a function of a soak time of the engine.

4. The method of claim 3 wherein the ratio is adjusted to exponentially decay as a function of the soak time.

5. The method of claim 4 wherein the initial temperature is determined according to:

$$T_{\text{injector_restart}} = T_{\text{coolant_restart}}\left(1-\left(1-\frac{T_{\text{injector_shutdown}}}{T_{\text{coolant_shutdown}}}\right)e^{-K(Time_{soak})}\right)$$

wherein K is a constant, $T_{injector_restart}$ is the initial temperature, $T_{coolant_restart}$ is a temperature of the engine coolant at restart, $T_{injector_shutdown}$ is the shutdown injector temperature, $T_{coolant_shutdown}$ is the shutdown temperature of the engine coolant, and $Time_{soak}$ is the soak time.

6. The method of claim 1 wherein the steady state temperature is calculated as a function of at least an engine coolant temperature and an air temperature.

7. The method of claim 6 wherein the steady state temperature is calculated as a weighted average.

8. The method of claim 7 wherein the weighted average is offset by an offset value determined as a function of exhaust gas flow.

9. The method of claim 1 wherein the predicting step comprises filtering the steady state temperature into the FITT with a lag filter at a rate determined by the filter coefficient.

10. The method of claim 9 wherein the predicting step comprises providing a feedback value of the FITT to the lag filter.

11. The method of claim 1 further comprising the step of triggering a hot restart purge (HRP) if the predicted temperature exceeds a pre-determined threshold value.

12. A method of predicting a fuel injector tip temperature (FITT) in an engine, the method comprising the steps of:

calculating a steady state temperature of the fuel injector tip as a function of at least an air temperature and a current temperature of an engine coolant;

determining a filter coefficient as a function of a rate of airflow into the engine; and predicting the FITT by filtering the steady state temperature into the FITT at a rate determined by the filter coefficient.

13. The method of claim 12 further comprising the step of estimating an initial temperature of the fuel injector tip as a function of a ratio between a shutdown injector temperature and a shutdown temperature of the engine coolant, wherein the ratio is adjusted as a function of a soak time of the engine.

14. The method of claim 13 wherein the predicting step comprises using the initial temperature as a first value of the FITT.

15. A method of predicting a fuel injector tip temperature (FITT) in an engine, comprising the steps of:

estimating an initial temperature of the fuel injector tip as a function of a ratio between a shutdown injector temperature and a shutdown temperature of an engine coolant, wherein the ratio is adjusted as a function of a soak time of the engine calculating a steady state temperature of the fuel injector tip as a function of at least an air temperature and a current temperature of the engine coolant;

determining a filter coefficient as a function of a rate of airflow into the engine; and predicting the FITT as a function of the initial temperature and the steady state temperature, wherein the steady state temperature is filtered into the FITT at a rate determined by the filter coefficient.

16. An apparatus for predicting a fuel injector tip temperature (FITT) in an engine, the apparatus comprising:

means for estimating an initial temperature of the fuel injector tip;

means for calculating a steady state temperature of the fuel injector tip;

means for determining a filter coefficient as a function of a rate of airflow into the engine; and means for predicting the FITT as a function of the initial temperature and the steady state temperature, wherein the steady state temperature is filtered into the FITT at a rate determined by the filter coefficient.

17. An apparatus for predicting a fuel injector tip temperature (FIT) in an engine, the apparatus comprising:

a first module configured to estimate an initial temperature of the fuel injector tip;

a second module configured to calculate a steady state temperature of the fuel injector tip;

a third module configured to determine a filter coefficient as a function of a rate of airflow into the engine; and a fourth module configured to predict the FITT as a function of the initial temperature and the steady state temperature, wherein the steady state temperature is filtered into the FITT at a rate determined by the filter coefficient.

18. A digital storage medium having computer-executable instructions stored thereon, the instructions comprising:

a first module configured to estimate an initial temperature of the fuel injector tip;

a second module configured to calculate a steady state temperature of the fuel injector tip;

a third module configured to determine a filter coefficient as a function of a rate of airflow into the engine; and a fourth module configured to predict a fuel injector tip temperature (FITT) as a function of the initial temperature and the steady state temperature, wherein the steady state temperature is filtered into the FITT at a rate determined by the filter coefficient.

19. A vehicle having an engine, a fuel injection system for the engine having at least one fuel injector tip, and an engine controller module having a processor and a memory configured to store computer-executable instructions for the processor, wherein the instructions comprise:

an estimating module configured to estimate an initial temperature of the fuel injector tip;

a calculating module configured to calculate a steady state temperature of the fuel injector tip;

a determining module configured to determine a filter coefficient as a function of a rate of airflow into the engine; and a predictor module configured to calculate a fuel injector tip temperature (FITT) a function of the initial temperature and the steady state temperature, wherein the steady state temperature is filtered into the FITT at a rate determined by the filter coefficient.

20. The vehicle of claim 19 further comprising hot restart purge (HRP) logic configured to receive the predicted temperature and to trigger a hot restart purge of a fuel canister if the predicted temperature exceeds a pre-determined threshold.

* * * * *